US010965007B2

(12) United States Patent
Kim et al.

(10) Patent No.: US 10,965,007 B2
(45) Date of Patent: Mar. 30, 2021

(54) ANTENNA MODULE

(71) Applicant: Samsung Electro-Mechanics Co., Ltd., Suwon-si (KR)

(72) Inventors: Jae Yeong Kim, Suwon-si (KR); Sung Yong An, Suwon-si (KR); Chang Hak Choi, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 232 days.

(21) Appl. No.: 16/149,440

(22) Filed: Oct. 2, 2018

(65) Prior Publication Data

US 2019/0190120 A1 Jun. 20, 2019

(30) Foreign Application Priority Data

Dec. 14, 2017 (KR) ..... 10-2017-0172322
May 30, 2018 (KR) ..... 10-2018-0061995

(51) Int. Cl.

| | |
|---|---|
| ***H01Q 21/06*** | (2006.01) |
| ***H01Q 1/24*** | (2006.01) |
| ***H01Q 1/38*** | (2006.01) |
| ***H01Q 1/48*** | (2006.01) |
| ***H01Q 21/00*** | (2006.01) |
| ***H01Q 1/52*** | (2006.01) |
| ***H01Q 21/28*** | (2006.01) |
| ***H01Q 9/04*** | (2006.01) |
| ***H01Q 1/22*** | (2006.01) |

(52) U.S. Cl.

CPC ..... *H01Q 1/243* (2013.01); *H01Q 1/2283* (2013.01); *H01Q 1/38* (2013.01); *H01Q 1/48* (2013.01); *H01Q 1/523* (2013.01); *H01Q 9/0457* (2013.01); *H01Q 21/0025* (2013.01); *H01Q 21/065* (2013.01); *H01Q 21/28* (2013.01)

(58) Field of Classification Search

CPC ..... H01Q 1/243; H01Q 1/523; H01Q 1/2283; H01Q 1/38; H01Q 1/48; H01Q 1/50; H01Q 1/2266; H01Q 1/22; H01Q 21/28; H01Q 21/065; H01Q 21/0025; H01Q 9/0457

See application file for complete search history.

(56) References Cited

U.S. PATENT DOCUMENTS 8,570,234 B2 10/2013 Tsai et al.
2009/0040120 A1* 2/2009 Tsubaki ..... H01Q 9/0421 343/702

(Continued)

FOREIGN PATENT DOCUMENTS

| | | | |
|---|---|---|---|
| JP | 2000-232315 | A | 8/2000 |
| WO | WO 2009/110679 | A1 | 9/2009 |
| WO | WO 2014/129754 | A1 | 8/2014 |

*Primary Examiner* — Awat M Salih
(74) *Attorney, Agent, or Firm* — NSIP Law

(57) ABSTRACT

An antenna module includes a substrate having a first surface including a ground region and a feeder region; chip antennas mounted on the first surface of the substrate; and at least one patch antenna disposed inside of the substrate or at least partially disposed on a second surface of the substrate. The chip antennas include a body portion, a ground portion bonded to a first surface of the body portion, and a radiation portion bonded to a second surface of a body portion. The ground portion of each chip antenna is mounted on the ground region and the radiation portion of each chip antenna is mounted on the feeder region.

25 Claims, 13 Drawing Sheets

(56) References Cited

U.S. PATENT DOCUMENTS

| | | | | |
|---|---|---|---|---|
| 2011/0043424 | A1 | 2/2011 | Lee et al. | |
| 2011/0102289 | A1* | 5/2011 | Leem | H01Q 1/2283 343/846 |
| 2015/0070228 | A1* | 3/2015 | Gu | H01Q 1/2283 343/727 |
| 2018/0048075 | A1* | 2/2018 | Park | H01Q 1/36 |

* cited by examiner

II-II'

ANTENNA MODULE

CROSS-REFERENCE TO RELATED APPLICATIONS

This application claims the benefit under 35 USC 119(a) of Korean Patent Application Nos. 10-2017-0172322 filed on Dec. 14, 2017 and 10-2018-0061995 filed on May 30, 2018 in the Korean Intellectual Property Office, the entire disclosures of which are incorporated herein by reference for all purposes.

BACKGROUND

1. Field

The following description relates to an antenna module.

2. Description of the Background

Enhanced fifth generation (5G) or preparatory 5G communication systems are being developed to meet the demand for increasing wireless data traffic after the deployment of fourth generation (4G) communication systems such as Long Term Evolution (LTE).

It is considered that 5G communication systems are implemented in higher frequency (mmWave) bands, e.g., 10 GHz to 100 GHz bands, to achieve higher data rates. In order to reduce the propagation loss of radio waves and increase transmission distances, beam forming, large-scale multiple-input multiple-output (MIMO), full dimensional MIMO (FD-MIMO), array antennas, analog beam forming, and large-scale antenna techniques are discussed in 5G communication systems.

Meanwhile, code-division multiple access (CDMA), wireless local area network (LAN), digital media broadcasting (DMB), and NFC (Near Field Communications) functions have been implemented in mobile communication terminals such as cellular phones, PDAs, navigation systems, and notebook computers supporting wireless communications. One important element enabling such functions is an antenna.

However, in the millimeter wave communications band to which 5G communication systems are applied, since the wavelength is reduced to several millimeters, it is difficult to use a conventional antenna. Accordingly, there is demand for an antenna module having an ultra-small size, mountable on a mobile communications terminal and suitable for the millimeter wave communications band.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna module includes a substrate having a first surface including a ground region and a feeder region; chip antennas mounted on the first surface of the substrate; and at least one patch antenna disposed inside of the substrate or at least partially disposed on a second surface of the substrate. The chip antennas include a body portion, a ground portion bonded to a first surface of the body portion, and a radiation portion bonded to a second surface of a body portion. The ground portion of each chip antenna is mounted on the ground region and the radiation portion of each chip antenna is mounted on the feeder region.

The chip antennas may be mounted on the substrate as pairs.

The first surface of the substrate may include an element mounting portion on which an electronic element is mounted, and the element mounting portion may be disposed inside of the ground region.

The substrate may include feeder pads disposed in the feeder region, and each of the feeder pads may be bonded to the radiation portion of a respective chip antenna, and the feeder pads may be electrically connected to the electronic element.

The feeder pads may be arranged in pairs, and a surface area of each of the feeder pads may be less than half of a surface area of a lower surface of the respective radiation portion bonded thereto.

Each of the chip antennas may be mounted on the first surface of the substrate so as not to overlap the at least one patch antenna along a direction perpendicular to the first surface of the substrate.

At least two of the feeder pads may be linearly formed and spaced from each other such that end portions face each other on a straight line, feeder vias may be respectively connected to the at least two feeder pads, and the feeder vias may be respectively disposed at the end portions of the feeder pads facing each other.

A distance between the at least two feeder pads may be 0.2 mm or greater and 0.5 mm or less.

The feeder region may be disposed along an edge of the substrate.

The feeder region may include regions spaced apart along an edge of the substrate.

The feeder region may partially dig into the ground region to reduce a distance between the feeder region and the element mounting portion.

For each of the chip antennas, a distance between the radiation portion and the ground region may be greater than or equal to 0.2 mm and less than or equal to 1.0 mm.

The chip antennas may be configured for wireless communications in a gigahertz frequency band and may be configured to receive a feeder signal from a signal processing element and radiate the feeder signal to outside, the body portion of each chip antenna may be formed in a hexahedral shape having a dielectric constant and the first surface and the second surface may be opposite surfaces of the body portion, the radiation portion may be formed in a hexahedral shape, and the ground portion may be formed in a hexahedral shape.

For each of the chip antennas, a total width along a long side may be less than or equal to 2 mm, and a ratio of a width of the radiation portion along the long side to a width of the body portion along the long side may be greater than or equal to 0.10.

For each of the chip antennas, the body portion may be a dielectric substance having a dielectric constant of 3.5 or greater and 25 or less.

For each of the chip antennas, a width of the radiation portion and a width of the ground portion may be 50% or less of a width of the body portion.

The at least one patch antenna may include a feeder electrode disposed inside of the substrate; and a non-feeder electrode disposed to be spaced apart from the feeder electrode by a predetermined distance.

The substrate may include a ground structure in the form of a container disposed around the at least one patch antenna to accommodate the at least one patch antenna.

The ground structure may include ground vias disposed along a circumference of the at least one patch antenna.

In another general aspect, an antenna module includes: a substrate having a surface that includes a ground region and a feeder region; and chip antennas mounted on the surface of the substrate. Each of the chip antennas includes a body portion, a ground portion coupled to a first surface of the body portion, and a radiation portion coupled to a second surface of the body portion. For each chip antenna, the ground portion is mounted on the ground region and the radiation portion is disposed outside of the ground region, and a distance between the radiation portion and the ground region is greater than or equal to 0.2 mm and less than or equal to 1 mm.

The feeder region may include regions spaced apart along an edge of the substrate.

The chip antennas may be used in wireless communications in a gigahertz frequency band and may be configured to receive a feeder signal from a signal processing element and radiate the feeder signal to outside. The body portion of each chip antenna may formed in a hexahedral shape having a dielectric constant and the first surface and the second surface may be opposite surfaces of the body portion. The radiation portion may be formed in a hexahedral shape, and the ground portion may be formed in a hexahedral shape.

In another general aspect, an apparatus includes: an antenna module including a substrate, a chip antenna mounted on a first surface of the substrate, a patch antenna disposed inside of the substrate or at least partially disposed on a second surface of the substrate. A radiation portion the antenna is coupled to a feeder region on the first surface of the substrate and the feeder region is disposed adjacent to an edge of the apparatus.

The antenna module may be disposed in the apparatus such that the chip antenna is adjacent to a corner of the apparatus.

The antenna module may include two or more chip antennas mounted on the first surface of the substrate and the two or more chip antennas may be mounted in pairs.

The radiation portions of each of the chip antennas in a pair may be disposed adjacent to each other.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
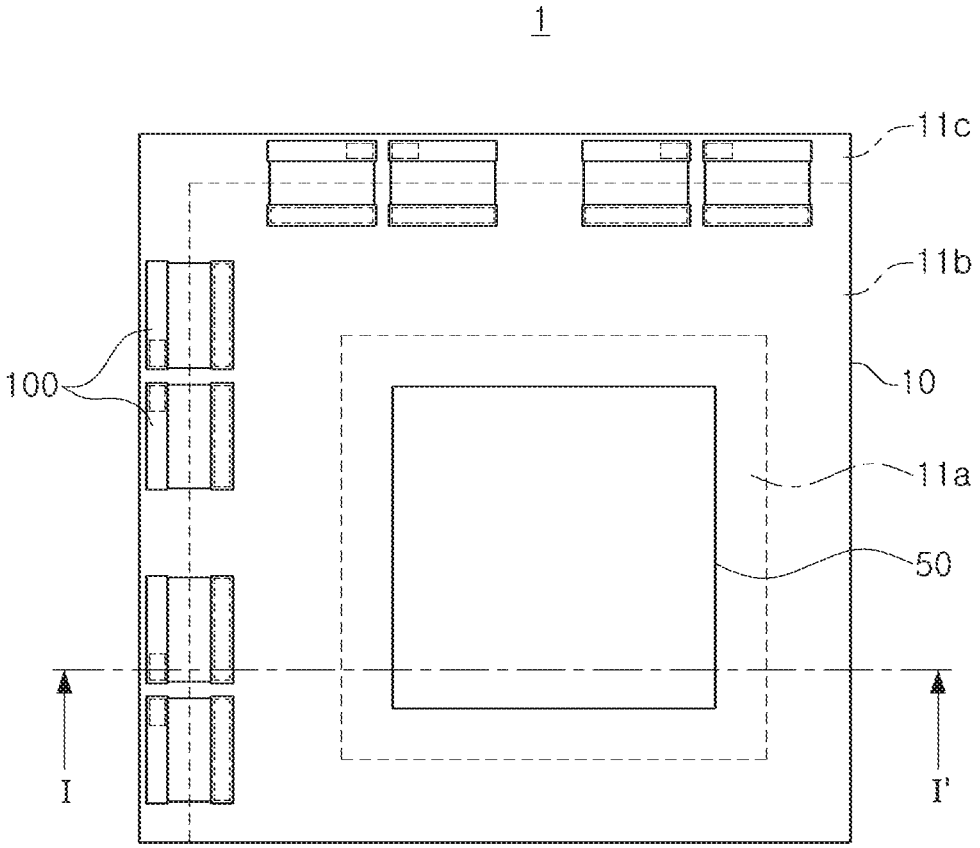
FIG. 1 is a plan view of an antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

An example of an antenna module described herein may operate in a high frequency domain and operate in a millimeter wave communications band. For example, a chip antenna module may operate in a frequency band between 20 GHz and 60 GHz. The examples of antenna modules described herein may also be mounted on an electronic device configured to receive or transmit wireless signals. For example, a chip antenna may be mounted on a portable telephone, a portable notebook, a drone or the like.

Figure 2:
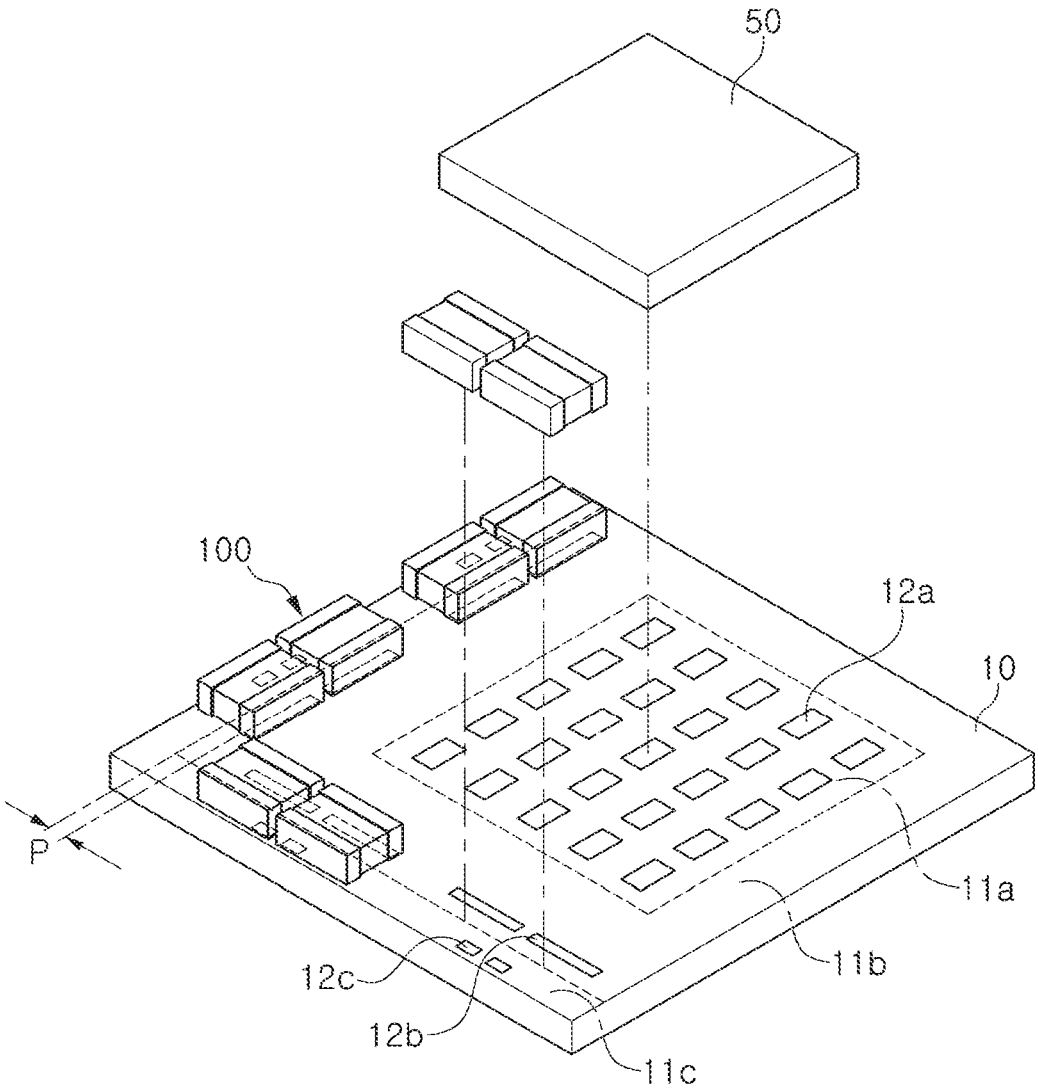
FIG. 2 is an exploded perspective view of the antenna module shown in FIG. 1.
Figure 3:
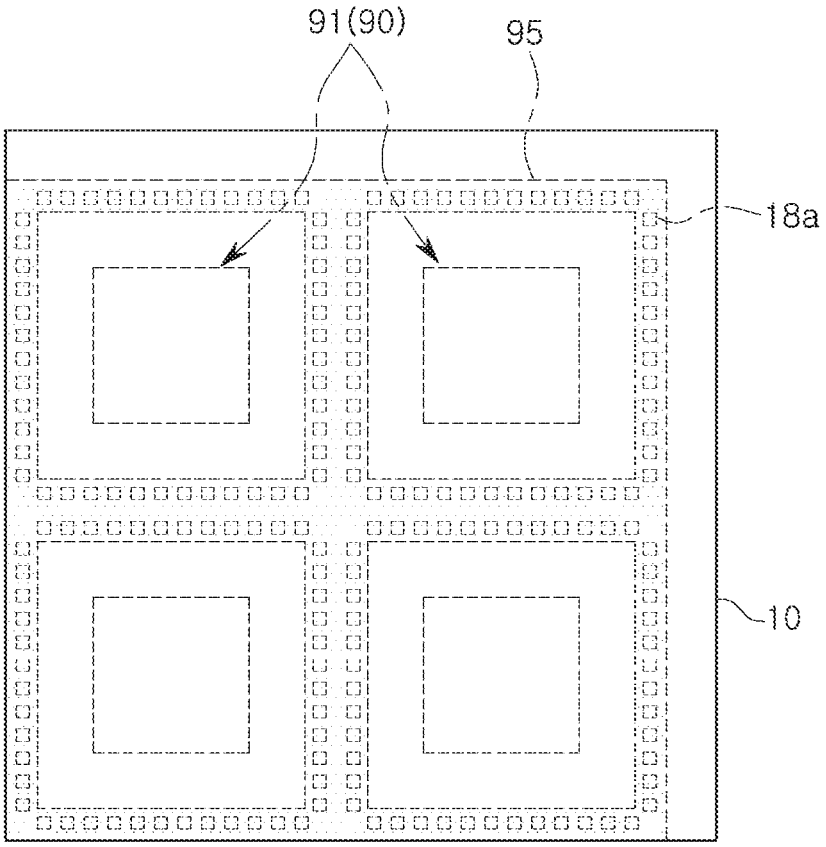
FIG. 3 is a bottom view of the antenna module shown in FIG. 1.
Figure 4:
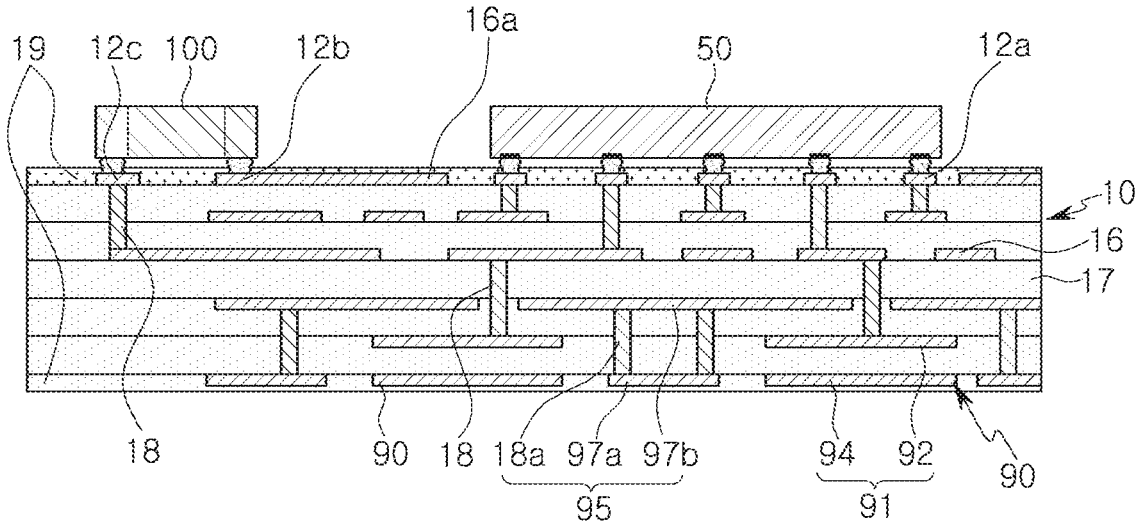
FIG. 4 is a cross-sectional view taken along line I-I' of FIG. 1.

FIG. 1 is a plan view of an antenna module 1 according to an example. FIG. 2 is an exploded perspective view of the antenna module 1 shown in FIG. 1. FIG. 3 is a bottom view of the antenna module 1 shown in FIG. 1. FIG. 4 is a cross-sectional view taken along line I-I' of FIG. 1.

Referring to FIGS. 1 through 4, the antenna module 1 includes a substrate 10, an electronic element 50, and a chip antenna 100.

The substrate 10 may be a circuit board on which a circuit or electronic parts necessary for a wireless antenna is mounted. For example, the substrate 10 may be a PCB that accommodates one or more electronic parts therein or one or more electronic parts mounted on a surface. Thus, the substrate 10 may be provided with a circuit wiring electrically connecting electronic parts.

The substrate 10 may be a multilayer substrate in which a plurality of insulating layers 17 and a plurality of wiring layers 16 are repeatedly stacked. However, it is also possible to use a double-sided board having wiring layers 16 formed on both sides of one insulating layer 17.

A material of the insulating layer 17 is not particularly limited. For example, a thermosetting resin such as an epoxy resin, a thermoplastic resin such as polyimide, or a resin impregnated with these resin and a core material such as glass fiber (glass fiber, glass cloth, and glass fabric) together with an inorganic filler, for example, an insulating material such as a prepreg, an Ajinomoto Build-up Film (ABF), FR-4, or bismaleimide triazine (BT) may be used. As needed, a photo imagable dielectric (PID) resin may be used.

The wiring layer 16 electrically connects an electronic element 50 and antennas 90 and 100. Also, the wiring layer 16 electrically connects the electronic element 50 or the antennas 90 and 100 externally.

As the material of the wiring layer 16, copper (Cu), aluminum (Al), silver (Ag), tin (Sn), gold (Au), nickel (Ni), lead (Pb), titanium (Ti) or a conductive material such as an alloy thereof may be used.

Interlayer connection conductors 18 for interconnecting the wiring layers 16 to be stacked are arranged inside the insulating layer 17.

An insulating protective layer 19 may also be disposed on the surface of the substrate 10. The insulating protective layer 19 is disposed to cover both the insulating layer 17 and the wiring layer 16 on the upper surface and the lower surface of the insulating layer 17. Thus, the insulating protective layer 19 protects the wiring layer 16 disposed on the upper surface or the lower surface of the insulating layer 17.

The insulating protective layer 19 may have an opening exposing at least a part of the wiring layer 16. The insulating protective layer 19 includes an insulating resin and an inorganic filler, but may not include glass fiber. For example, a solder resist may be used as the insulating protective layer 19, but the disclosure is not limited to such a configuration.

As the substrate 10, various kinds of substrates (for example, a printed circuit board, a flexible substrate, a ceramic substrate, a glass substrate, etc.) well known in the art may also be used.

A first surface, an upper surface of the substrate 10, may be divided into an element mounting portion 11*a*, a ground region 11*b*, and a feeder region 11*c*.

The element mounting portion 11*a* is disposed inside of the ground region 11*b* as a region in which the electronic element 50 is mounted. A plurality of connection pads 12*a* to which the electronic element 50 is electrically connected are arranged in the element mounting portion 11*a*.

The ground region 11*b* is a region in which a ground layer 16*a* is disposed and is disposed to surround the element mounting portion 11*a*. Therefore, the element mounting portion 11*a* is disposed inside of the ground region 11*b*.

Here, one of the wiring layers 16 of the substrate 10 may be used as the ground layer 16*a*. Therefore, the ground layer 16*a* may be disposed on the upper surface of the insulating layer 17 or between two stacked insulating layers 17.

In the present example, the element mounting portion 11*a* is formed in a rectangular shape. Therefore, the ground region 11*b* is disposed to surround the element mounting portion 11*a* in the form of a square ring. However, the disclosure is not limited to such a configuration.

Since the ground region 11*b* is disposed along the circumstance of the element mounting portion 11*a*, the connection pad 12*a* of the element mounting portion 11*a* is electrically connected to outside or other components through the interlayer connection conductor 18 passing through the insulating layer 17 of the substrate 10.

A plurality of ground pads 12*b* are formed in the ground region 11*b*. When the ground layer 16*a* is disposed on the upper surface of the insulating layer 17, the ground pad 12*b* may be formed by partially opening the insulating protective layer 19 covering the ground layer 16*a*. Therefore, in this case, the ground pad 12*b* is configured as a part of the ground layer 16*a*. However, the disclosure is not limited to such a configuration. When the ground layer 16*a* is disposed between two insulating layers 17, the ground pad 12*b* may be disposed on the upper surface of the insulating layer 17, and the ground pad 12*b* and the ground layer 16*a* may be connected through the interlayer connection conductors 18.

The ground pad 12*b* is disposed to be paired with a feeder pad 12*c*. Therefore, the ground pad 12*b* is disposed at a position adjacent to the feeder pad 12*c*.

The feeder region 11*c* is disposed outside the ground region 11*b*. In the present example, the feeder region 11*c* is formed outside of two sides formed by the ground region 11*b*. Therefore, the feeder region 11*c* is disposed along the edge of the substrate 10. However, the disclosure is not limited to such a configuration.

A plurality of feeder pads 12*c* are disposed in the feeder region 11*c*. The feeder pad 12*c* is disposed on the upper surface of the insulating layer 17 and a radiation portion 130*a* of the chip antenna 100 is bonded thereto.

The feeder pad 12*c* is electrically connected to the electronic element 50 and other components via the interlayer connection conductor 18 and the wiring layer 16 that penetrate the insulating layer 17 of the substrate 10.

In the element mounting portion 11*a*, the ground region 11*b*, and the feeder region 11*c* as configured above, respective regions are classified in the upper portion according to the shape and position of the ground layer 16*a*. The connection pad 12*a*, the ground pad 12*b* and the feeder pads 12*c* are exposed externally in the form of a pad through openings from which the insulating protective layer 19 is removed.

Also, in the present example, the feeder pad 12*c* is formed to have a smaller area (surface area) than the lower surface (or a bonding surface) of the radiation portion 130*a* of the chip antenna 100. For example, the area (surface area) of the feeder pad 12*c* may be less than half the area (surface area) of the lower surface (or the bonding surface) of the radiation portion 130*a* of the chip antenna 100. Thus, the feeder pad 12*c* is not bonded to the entire lower surface of the radiation portion 130*a* but is bonded to only a part of the lower surface of the radiation portion 130*a*.

Meanwhile, when the feeder pad 12*c* is configured with an excessively small area, the reliability of bonding between the chip antenna 100 and the substrate 10 may be reduced. Accordingly, the feeder pad 12*c* of the present example is formed in a rectangular shape, and the longest side is formed to have a length equal to or greater than a width W2 of the radiation portion 130*a*.

In the present example, each two of the feeder pads 12*c* are also arranged in pairs. Referring to FIG. 1, a total of four feeder pads 12*c* are each two arranged in pairs. However, the disclosure is not limited to such a configuration. The number of pairs formed by the feeder pads 12*c* may be changed according to the size of a module or the like.

The paired feeder pads 12*c* are disposed adjacently to each other. Thus, two chip antennas 100 bonded to the pair of feeder pads 12*c* are bonded to the feeder pads 12*c* at the end portions of the radiation portions 130*a*, respectively.

Accordingly, the two radiation portions 130*a* provided in two adjacent chip antennas 100 are arranged in a line, and are arranged as adjacent as possible at a portion bonded to the feeder pad 12*c*.

Meanwhile, the feeder pad 12*c* is not limited to the above configuration, and various modifications are possible. For example, the feeder pad 12*c* may have the same or similar area (surface area) as that of the lower surface of the radiation portion 130*a* of the chip antenna 100. In this case, the reliability of bonding between the chip antenna 100 and the substrate 10 may be improved.

The feeder pad 12*c* is electrically connected to the electronic element 50 via the interlayer connection conductor 18. To this end, the interlayer connection conductor 18 extends inside the substrate 10 in a direction perpendicular to the feeder pad 12*c* and is connected to the wiring layer 16 inside the substrate 10.

A patch antenna 90 is disposed on a second surface, the inner side or the lower surface of the substrate 10.

The patch antenna 90 may be configured by the wiring layer 16 provided on the substrate 10. However, the disclosure is not limited to such a configuration.

As shown in FIGS. 3 and 4, the patch antenna 90 includes a feeder portion 91 including a feeder electrode 92 and a non-feeder electrode 94.

In the present example, the patch antenna 90 includes a plurality of feeder portions 91 dispersedly arranged on the second surface side of the substrate 10. In the present example, four feeder portions 91 are provided, but the disclosure is not limited to such a configuration.

In the present example, the patch antenna 90 is configured such that a part (e.g., a non-feeder electrode) of the patch antenna 90 is disposed on the second surface of the substrate 10. However, the disclosure is not limited to such a configuration, and various configurations are possible, such as disposing the entire patch antenna 90 inside the substrate 10.

The feeder electrode 92 is a metal layer having a flat plate shape and is configured as one conductor plate. The feeder electrode 92 may have a polygonal structure and is formed in a rectangular shape in the present example. However, various configurations are possible such as the feeder electrode 92 may be formed in a circular shape.

The feeder electrode 92 may be connected to the electronic element 50 through the interlayer connection conductor 18. The interlayer connection conductor 18 may be connected to the electronic element 50 by penetrating a second ground layer 97*b*.

The non-feeder electrode 94 is disposed spaced by a certain distance from the feeder electrode 92 and is formed as a single flat conductive plate. The non-feeder electrode 94 has the same or similar area (surface area) as the feeder electrode 92. For example, the non-feeder electrode 94 may be formed to have a larger area (surface area) than the feeder electrode 92 and disposed to face the entire feeder electrode 92.

The non-feeder electrode 94 is disposed on the surface side of the substrate 10 and functions as a director. Thus, the non-feeder electrode 94 may be disposed on the wiring layer 16 disposed at the lowermost portion of the substrate 10. In this case, the non-feeder electrode 94 is protected by the insulating protective layer 19 disposed on the lower surface of the insulating layer 17.

The substrate 10 of the present example also includes a ground structure 95. The ground structure 95 is disposed around the feeder portion 91 and configured in the form of a container accommodating the feeder portion 91 therein. To this end, the ground structure 95 includes a first ground layer 97*a*, a second ground layer 97*b*, and a ground via 18*a*.

Referring to FIG. 4, the first ground layer 97*a* is disposed on the same plane as the non-feeder electrode 94 and is disposed around the non-feeder electrode 94 in such a manner as to surround the non-feeder electrode 94. The first ground layer 97*a* is spaced apart from the non-feeder electrode 94 by a certain distance.

The second ground layer 97*b* is disposed in a wiring layer 16 different from the first ground layer 97*a*. For example, the second ground layer 97*b* may be disposed between the feeder electrode 92 and the first surface of the substrate 10. In this case, the feeder electrode 92 is disposed between the non-feeder electrode 94 and the second ground layer 97*b*.

The second ground layer 97*b* may be entirely disposed on the corresponding wiring layer 16 and may be partially removed only in a portion in which the interlayer connection conductor 18 connected to the feeder electrode 92 is disposed.

The ground via 18*a* is an interlayer connection conductor that electrically connects the first ground layer 97*a* and the second ground layer 97*b* and is arranged as a plurality of ground vias in such a manner as to surround the feeder portion 91 along the circumference of the feeder portion 91. In the present example, the ground vias 18*a* are arranged in a single row. However, various configurations are possible, such as the ground vias 18*a* being arranged in a plurality of rows.

According to the above configuration, the feeder portion 91 is disposed in the ground structure 95 formed in the shape of the container by the first ground layer 97*a*, the second ground layer 97*b*, and the ground via 18*a*. The plurality of ground vias 18*a* arranged in a line define side surfaces in the shape of the container.

Each of the feeder portions 91 of the present example is disposed in the shape of the container. Therefore, the interference between the feeder portions 91 is blocked by the ground structure 95. For example, noise transmitted in the horizontal direction of the substrate 10 may be blocked by the side surface in the shape of the container configured by the plurality of ground vias 18*a*.

As the ground vias 18*a* form the side surface of a cavity, the feeder portion 91 is isolated from the adjacent other feeder portions 91. Further, since the ground structure 95 in the shape of the container serves as a reflector, the radiation characteristic of the patch antenna 90 may be enhanced.

The feeder portion 91 of the patch antenna 90 emits a radio signal in the thickness direction (e.g., the lower direction) of the substrate 10.

Meanwhile, referring to FIG. 3, the first ground layer 97*a* and the second ground layer 97*b* in the present example are not disposed in a region facing the feeder region (11*c* in FIG. 2) defined on the first surface of the substrate 10. This is for the purpose of minimizing interference between the radio signal radiated from the chip antenna and the ground structure 95, but is not limited thereto.

Also, in the present example, the patch antenna 90 includes the feeder electrode 92 and the non-feeder electrode 94. However, various configurations are possible, and the patch antenna 90 may be configured to include only the feeder electrode 92.

The electronic element 50 is mounted on the element mounting portion 11*a* of the substrate 10. The electronic element 50 may be bonded to a connection pad 12*a* of the element mounting portion 11*a* via a conductive adhesive.

In the present example, one electronic element 50 is mounted on the element mounting portion 11*a*. However, a plurality of electronic elements 50 may be mounted on the element mounting portion 11*a*.

The electronic element 50 includes at least one active element, and may include, for example, a signal processing element applying a feeder signal to the radiation portion 130*a* of the antenna. The electronic element 50 may also include a passive element.

The chip antenna 100 is used in wireless communications in a gigahertz frequency band and is mounted on the substrate 10 to receive a feeder signal from the electronic element 50 and radiate it externally.

The chip antenna 100 is formed in a hexahedral shape as a whole and has both ends connected to the feeder pad 12*c* and the ground pad 12*b* of the substrate 10 respectively via a conductive adhesive such as solder and mounted on the substrate 10.

Figure 5:
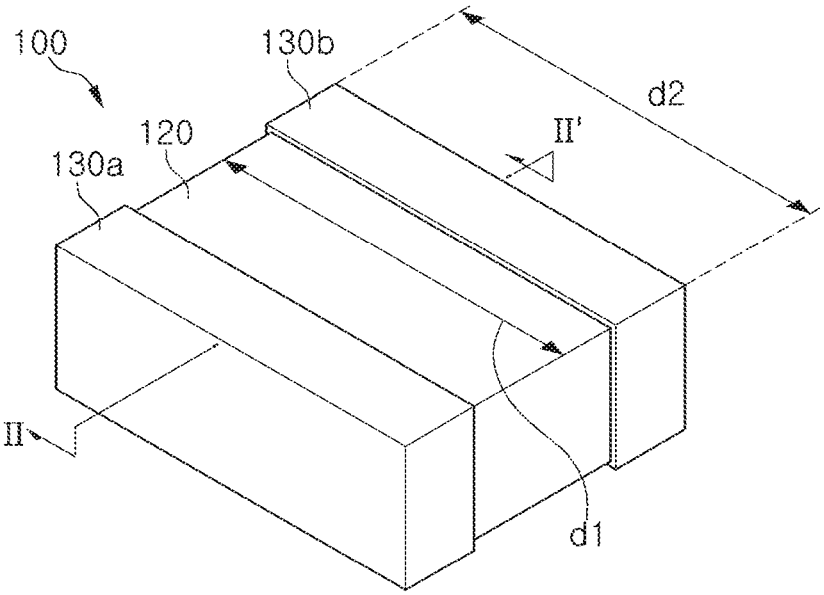
FIG. 5 is an enlarged perspective view of the chip antenna shown in FIG. 1.
Figure 6:
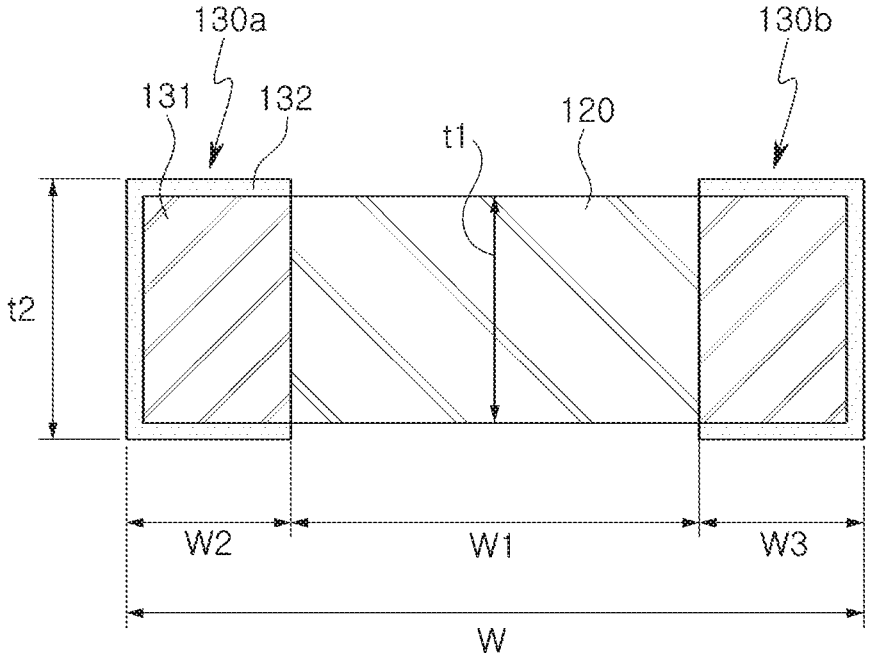
FIG. 6 is a cross-sectional view taken along line Ill l' of FIG. 5.

FIG. 5 is an enlarged perspective view of the chip antenna 100 shown in FIG. 1. FIG. 6 is a cross-sectional view taken along line I-I' of FIG. 5.

Referring to FIGS. 5 and 6, the chip antenna 100 includes a body portion 120, a radiation portion 130*a*, and a ground portion 130*b*.

The body portion 120 has a hexahedral shape and is formed of a dielectric substance. For example, the body portion 120 may be formed of a polymer having a dielectric constant or a ceramic sintered body.

The chip antenna 100 according to the present example is a chip antenna used in a 3 GHz to 30 GHz band.

A wavelength A of the electromagnetic wave from 3 GHz to 30 GHz is 100 mm to 0.75 mm, and the length of the antenna is theoretically $\lambda$, $\lambda/2$, and $\lambda/4$. Therefore, the length of a radiation antenna should be approximately 50 mm to 25 mm. However, when the body portion 120 is formed of a material having a dielectric constant higher than that of air, the length thereof may be remarkably reduced.

The chip antenna 100 of the present example configures the body portion 120 formed of a material having a dielectric constant of 3.5 to 25. In this case, the maximum length of the chip antenna 100 may be manufactured within a range of 0.5 to 2 mm.

When the dielectric constant of the body portion 120 is less than 3.5, a distance between the radiation portion 130*a* and the ground portion 130*b* must be increased in order for the chip antenna 100 to operate normally.

As a result of the test, when the dielectric constant of the body portion 120 is less than 3.5, the chip antenna 100 is measured to function normally in the 3 GHz~30 GHz band only at the maximum width W of 2 mm or more. However, in this case, since the overall size of the chip antenna 100 is increased, it is difficult to mount the chip antenna 100 on a thin portable device.

Therefore, the length of the longest side of the chip antenna 100 of the present example is 2 mm or less in consideration of the wavelength length and the mounting size. For example, in order to adjust the resonance frequency in the above frequency band, the chip antenna 100 according to the present example may have a length of the longest side of 0.5 to 2 mm.

Also, when the dielectric constant of the body portion 120 exceeds 25, the size of the chip antenna 100 should be reduced to 0.3 mm or less. In this case, the performance of the antenna is measured to be rather degraded.

Therefore, the body portion 120 of the chip antenna 100 according to the present example is formed of a dielectric having a dielectric constant of 3.5 or more and 25 or less.

The radiation portion 130*a* is coupled to a first surface of the body portion 120. The ground portion 130*b* is coupled to a second surface of the body portion 120. Here, the first surface and the second surface refer to two surfaces facing each other in the body portion 120 formed as a hexahedron.

In the present example, the width W1 of the body portion 120 is defined as a distance between the first surface and the second surface. A direction toward the second surface from the first surface of the body portion 120 (or a direction from the second surface toward the first surface of the body portion 120) is defined as a width direction of the body portion 120 or the chip antenna 100.

In this regard, the widths W2 and W3 of the radiation portion 130*a* and the ground portion 130*b* are defined as distances in the width direction of the chip antenna 100. Thus, the width W2 of the radiation portion 130*a* means the shortest distance from a bonding surface of the radiation portion 130*a* bonded to the first surface of the body portion 120 to an opposite surface of the bonding surface, and the width W3 of the first portion 130*b* means the shortest distance from a bonding surface of the ground portion 130*b* bonded to the second surface of the body portion 120 to an opposite surface of the bonding surface.

The radiation portion 130*a* is in contact with only one of the six surfaces of the body portion 120 and is coupled to the body portion 120. Similarly, the ground portion 130*b* is in contact with only one of the six surfaces of the body portion 120 and is coupled to the body portion 120.

The radiation portion 130*a* and the ground portion 130*b* are not disposed on surfaces other than the first and second surfaces of the body portion 120, but are arranged parallel to each other with the body portion 120 interposed therebetween.

In the conventional chip antenna used in a low frequency band, a radiation portion and a ground portion are arranged in the form of a thin film on a lower surface of the body portion. In this conventional case, since a distance between the radiation portion and the ground portion is small and thus the radiation portion and the ground portion are close to each other, a loss due to inductance occurs. Also, since it is difficult to precisely control the distance between the radiation portion and the ground portion in a manufacturing process, accurate capacitance may not be predicted, and it is difficult to adjust a resonance point, which makes tuning of the impedance difficult.

However, in the chip antenna 100 according to the present example, the radiation portion 130*a* and the ground portion 130*b* are formed in a block shape and are coupled to a first surface and a second surface of the body portion 120, respectively. In the present example, the radiation portion 130*a* and the ground portion 130*b* are each formed in a hexahedral shape, and one surface of the hexahedron is bonded to each of a first surface and a second surface of the body portion 120.

As such, when the radiation portion 130*a* and the ground portion 130*b* are coupled to only the first surface and the second surface of the body portion 120, since a separation distance between the radiation portion 130*a* and the ground portion 130*b* is defined by only the size of the body portion 120, all of the above discussed problems with the conventional chip antenna may be resolved.

Also, since the chip antenna 100 of the present disclosure has capacitance due to a dielectric substance (for example, a body portion) between the radiation portion 130*a* and the ground portion 130*b*, it is possible to design a coupling antenna or to adjust a resonance frequency by using the capacitance.

The radiation portion 130*a* and the ground portion 130*b* may be formed of the same material. The radiation portion 130*a* and the ground portion 130*b* may be formed to have the same shape and the same structure. In this case, the radiation portion 130*a* and the ground portion 130*b* may be classified according to a type of a pad to be bonded when mounted on the substrate 10.

For example, in the chip antenna 100 according to the present example, a portion of the substrate 10 bonded to the feeder pad 12*c* of the substrate 10 may function as the radiation portion 130*a*, and a portion of the substrate 10 bonded to the ground pad 12*b* may function as the ground portion 130*b*. However, the disclosure is not limited to such a configuration.

The radiation portion 130*a* and the ground portion 130*b* include a first conductor 131 and a second conductor 132.

The first conductor 131 is a conductor directly bonded to the body portion 120 and is formed in a block shape. The second conductor 132 is formed in the form of a layer along a surface of the first conductor 131.

The first conductor 131 is formed on one surface of the body portion 120 through a printing process or a plating process and may be formed of one kind or two or more kinds of alloy selected from the group consisting of Ag, Au, Cu, Al, Pt, Ti, Mo, Ni, and W. The first conductor 131 may be also formed of a conductive paste or a conductive epoxy in which an organic material such as a polymer or a glass is contained in metal.

The second conductor 132 may be formed on the surface of the first conductor 131 through a plating process. The second conductor 132 may be formed by sequentially stacking a nickel (Ni) layer and a tin (Sn) layer, or by sequentially stacking a zinc (Zn) layer and a tin (Sn) layer.

Referring to FIGS. 5 and 6, a thickness t2 of the radiation portion 130*a* and the ground portion 130*b* is formed to be greater than a thickness t1 of the body portion 120. A length d2 of the radiation portion 130*a* and the ground portion 130*b* is also greater than a length d1 of the body portion 120.

However, the first conductor 131 is formed to have the same thickness and the same length as the thickness t1 and length d1 of the body portion 120.

Therefore, the radiation portion 130*a* and the ground portion 130*b* are formed to be longer than the body portion 120 by virtue of the second conductor 132 formed on the surface of the first conductor 131.

Figure 15:
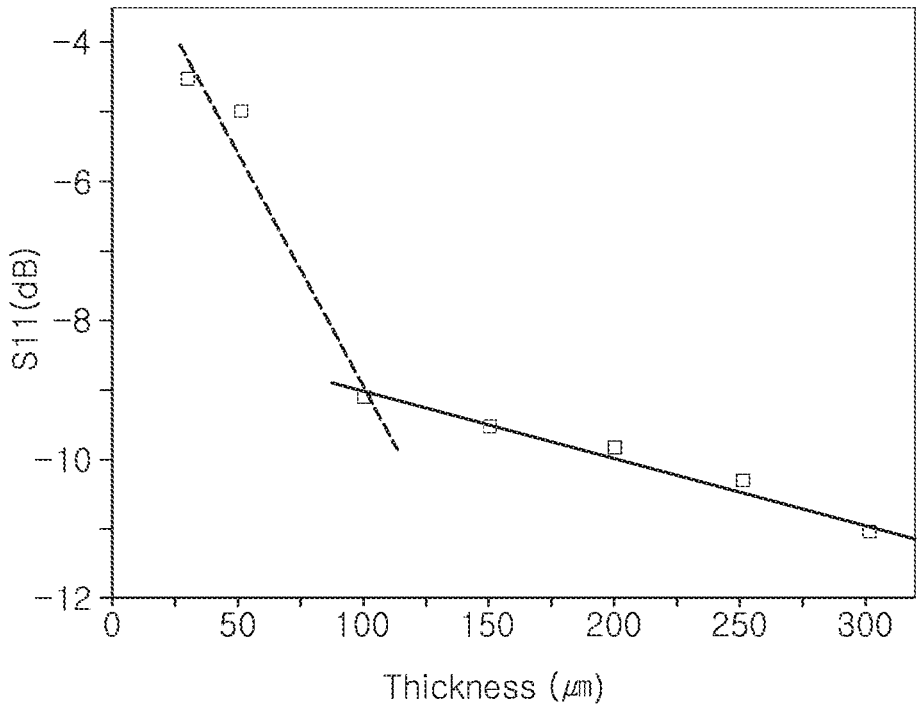
FIG. 15 is a graph showing the radiation efficiency of the chip antenna shown in FIG. 5.

FIG. 15 is a graph showing the radiation efficiency of a chip antenna shown in FIG. 5, wherein the widths W2 and W3 of the radiation portion 130*a* and the ground portion 130*b* are increased in a 28 GHz band, and a reflection loss S11 of the chip antenna is measured.

The chip antenna used for measurement is measured by fixing the width W1 of the body portion 120 of 1 mm, the thickness t2 of the radiation portion 130*a* and the ground portion 130*b* of 0.6 mm, and the length d2 of 1.3 mm, and varying only the widths W2 and W3.

Referring to FIG. 15, the reflection loss S11 of the chip antenna according to the example decreases as the widths W2 and W3 of the radiation portion 130*a* and the ground portion 130*b* increase. It is measured that the reflection loss S11 decreases at a high reduction rate in a section where the widths W2 and W3 of the radiation portion 130*a* and the ground portion 130*b* are less than or equal to 100 μm and the reflection loss S11 decreases at a relatively low reduction rate in a section where the widths W2 and W3 exceed 100 μm.

Thus, when the width W1 of the body portion 120 is 1 mm in the example, the width W2 of the radiation portion 130*a* and the width W3 of the ground portion 130*b* are defined to be equal to or more than 100 μm.

Accordingly, the chip antenna according to the example satisfies Equation 1 below with respect to the width W1 of the body portion 120 and the width W2 of the radiation portion 130*a*.

$$W2/W1 \geq 1/10 \quad \text{(Equation 1)}$$

Meanwhile, when the widths W2 and W3 of the radiation portion 130*a* and the ground portion 130*b* are larger than the width W1 of the body portion 120, the radiation portion 130*a* or the ground portion 130*b* may be separated from the body portion 120 due to an external shock or when mounted on a substrate. Therefore, in the present example, the maximum widths W2 and W3 of the radiation portion 130*a* and the ground portion 130*b* are defined as 50% or less of the width W1 of the body portion 120.

Since the maximum length of the chip antenna according to the present example is 2 mm, when the radiation portion 130*a* and the ground portion 130*b* are formed to have the same width, the maximum width of the radiation portion 130*a* or the ground portion 130*b* may be defined as 500 μm. However, the disclosure is not limited to such a configuration, and the maximum width may be changed when the widths of the radiation portion 130*a* and the ground portion 130*b* are different from each other.

The chip antenna according to the examples may be used in a high frequency band equal to or more than 3 GHz less than or equal to 30 GHz and may have a long side having a size less than or equal to 2 mm and may be easily mounted on a thin portable device.

Also, since the radiation portion 130*a* and the ground portion 130*b* are in contact with only one surface of the body portion 120, it is easy to tune the resonance frequency, and the antenna radiation efficiency may be maximized by adjusting the antenna volume.

Meanwhile, the chip antenna according to the disclosure is not limited to the above-described configuration, and various configurations are possible.

FIGS. 7 through 10 are perspective views illustrating a chip antenna according to other examples.

Figure 7:
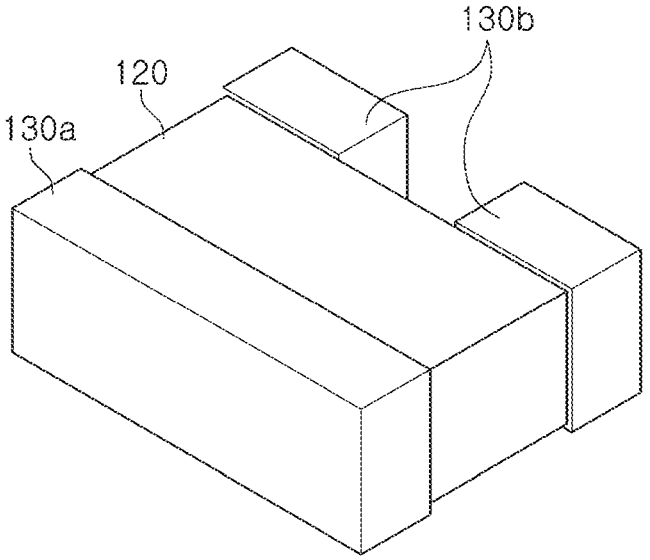
FIGS. 7 through 10 are perspective views illustrating a chip antenna according to an example.
Figure 8:
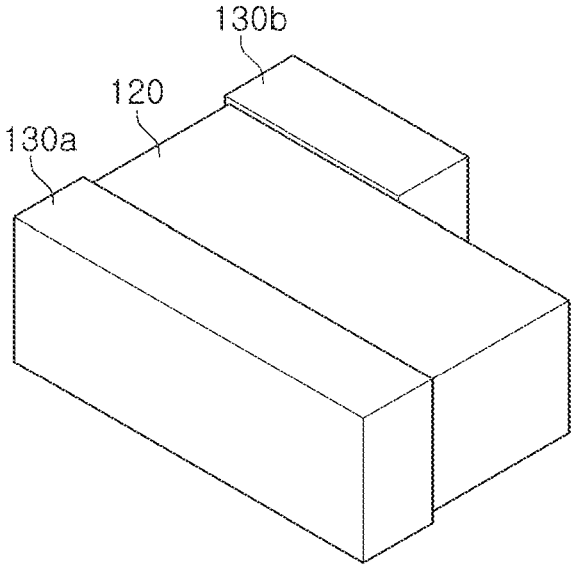
Figure 9:
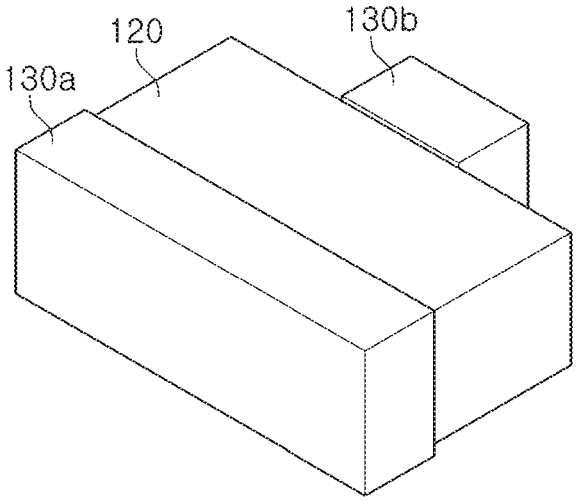

FIGS. 7 through 9 show chip antennas of various modifications of a shape of the ground portion 130*b*. Specifically, in the chip antenna shown in FIG. 7, two ground portions 130*b* are disposed apart from each other. Accordingly, an empty space is provided between the two ground portions 130*b*, and the overall size (length) of the ground portion 130*b* is formed to be smaller than the radiation portion 130*a*.

In the chip antenna shown in FIG. 8, the ground portion 130*b* has a length of about half of the radiation portion 130*a*, and is disposed at a position inclined to one side on a second surface of the body portion 120. In the chip antenna shown in FIG. 9, the ground portion 130*b* is less than half the length of the radiation portion 130*a*, and is centered on the second surface of the body portion 120.

Meanwhile, although a configuration of the ground portion 130*b* is modified in the above examples, the present disclosure is not limited thereto. The radiation portion 130*a* may be used by modifying a shape of the radiation portion 130*a* instead of the ground portion 130*b*.

Figure 10:
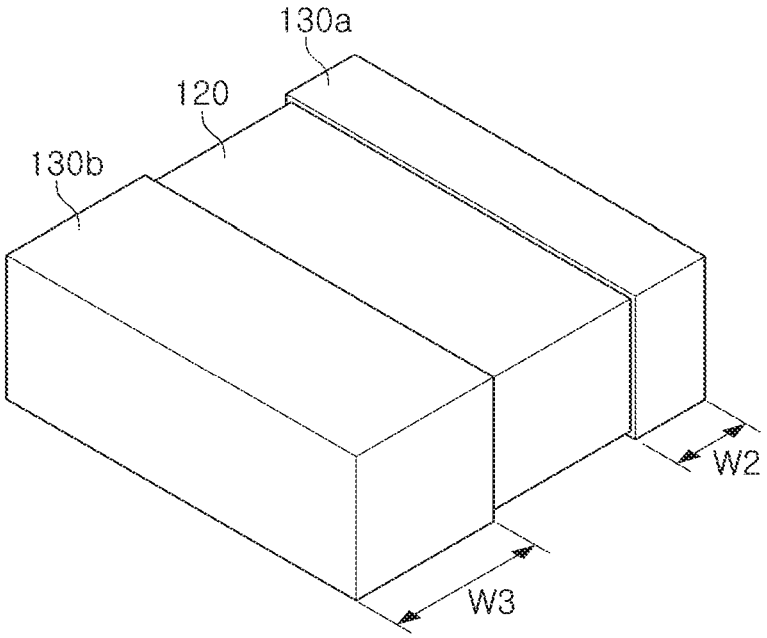

In FIG. 10, the ground portion 130*b* has a larger volume than the radiation portion 130*a*. In the present example, the width W3 of the ground portion 130*b* is formed to be twice as large as the width W2 of the radiation portion 130*a*. For example, the width W2 of the radiation portion 130*a* may be greater than the width W3 of the ground portion 130*b* by 50 μm or more. However, the disclosure is not limited to such a configuration.

The antenna module according to the examples radiates horizontal polarization using a chip antenna and radiates vertical polarization using a patch antenna. That is, the chip antennas are disposed in a position adjacent to an edge of a substrate to radiate radio waves in a direction (e.g., a planar direction) horizontal to the substrate, and the patch antenna is disposed on a second surface of the substrate to radiate radio waves in a direction (e.g., a thickness direction) vertical to the substrate. Therefore, the radiation efficiency of the radio waves may be increased.

Although the patch antenna is disposed on the second surface of the substrate in the examples, various modifications are possible such as the patch antenna being disposed on the first surface of the substrate, and an element mounting portion and the chip antennas being disposed on the second surface of the substrate.

The two chip antennas 100 according to the examples are paired and bonded to the two feeder pads 12*c*, respectively. The two radiation portions 130*a* are arranged to be as adjacent as possible to each other at a portion bonded to the feeder pad 12*c*, and thus the two chip antennas 100 are a structure of a dipole antenna. Here, a distance at which the two chip antennas 100 are spaced apart (or a distance at which the two feeder pads 12*c* are spaced apart) may be defined as 0.2 mm to 0.5 mm. When the distance is less than 0.2 mm, interference may occur between the two chip antennas 100. When the distance is 0.5 mm or more, functions of the two chip antennas 100 as the dipole antenna may be degraded.

Meanwhile, it may also be considered to configure the dipole antenna with circuit wiring by using the wiring layer 16 of the substrate 10 instead of the chip antenna 100. However, since the length of the radiation portion 130*a* should be a half wavelength of the corresponding frequency, if the dipole antenna is formed by using the wiring layer 16 of the substrate 10, an area of the substrate 10 occupied by the dipole antenna is relatively large.

When radio waves are transmitted/received in the Ghz band, a wavelength is reduced by a dielectric constant of the body portion 120. Therefore, when the chip antenna 100 is used as in the examples, a distance (P of FIG. 2) between the radiation portion 130*a* and the ground region 11*b* may be reduced through a dielectric constant (e.g. 10 or more) of the body portion 120. Thus, the area in which the feeder region 11*c* or the chip antenna 100 is mounted on the substrate 10 may be minimized.

For example, when the dipole antenna is formed as a wiring layer on the first surface of the substrate 10, a feeder line of the dipole antenna should be spaced by 1 mm or more from a ground region. Meanwhile, when the chip antenna 100 of the examples is applied, the distance P between the radiation portion 130*a* and the ground region 11*b* may be designed to be 1 mm or less.

Therefore, the size of the feeder region 11*c* may be reduced, as compared with the case of using the dipole antenna, and thus the overall size of the antenna module may be minimized.

Meanwhile, when the distance P between the radiation portion 130*a* and the ground region 11*b* of the chip antenna 100 is less than 0.2 mm, the resonance frequency of the chip antenna 100 may be changed. Therefore, in the examples, the radiation portion 130*a* of the chip antenna 100 and the ground region 11*b* of the substrate 10 may be spaced apart from each other by a range equal to or more than 0.2 mm and less than or equal to 1 mm.

Also, the chip antenna 100 is disposed at a position not facing the patch antenna along the vertical direction of the substrate 10. Upon describing the present disclosure, the position where the chip antenna 100 does not face the patch antenna along the vertical direction of the substrate 10 means a position where the chip antenna 100 is disposed not to overlap with the patch antenna when the chip antenna 100 is projected on the second surface of the substrate 10 in the vertical direction of the substrate 10.

In the examples, the chip antenna 100 is also disposed not to face the ground structure 95. However, the present disclosure is not limited thereto, and the chip antenna may be disposed to partially face the ground structure 95.

With the above configuration, the antenna module according to the present example minimizes the interference between the chip antenna 100 and the patch antenna 90.

Figure 11:
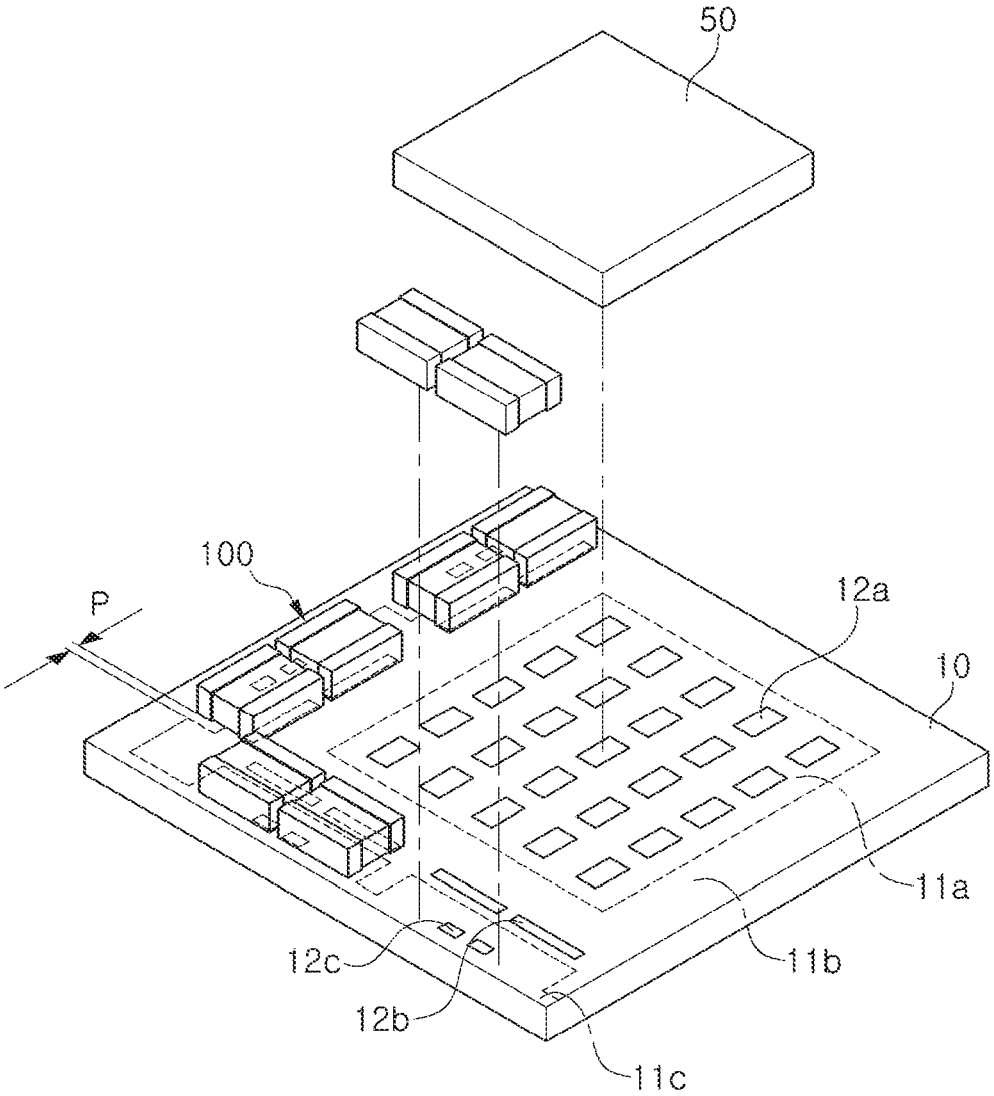
FIG. 11 is a perspective view of an antenna module according to an example.
Figure 12:
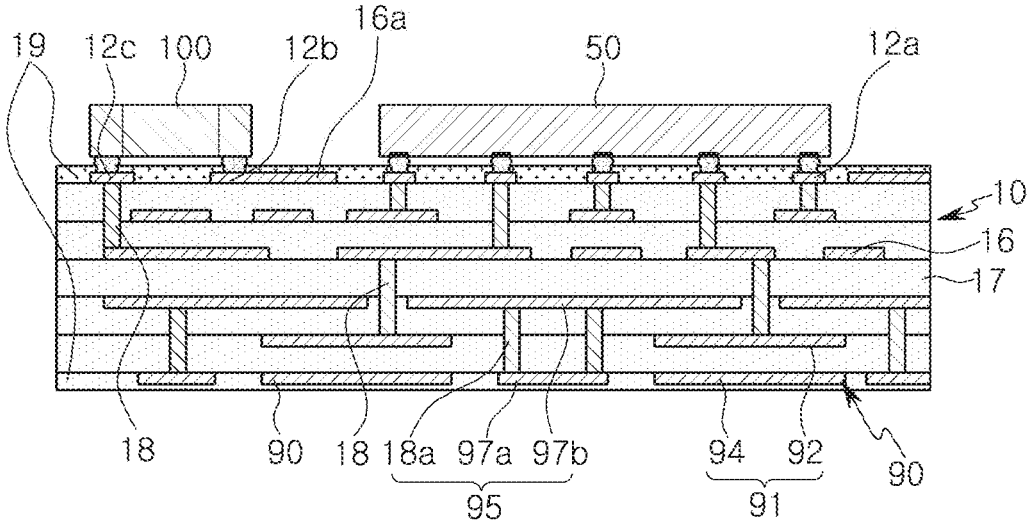
FIG. 12 is a cross-sectional view of FIG. 11.

FIG. 11 is a perspective view of an antenna module according to another example. FIG. 12 is a cross-sectional view of FIG. 11 and shows a cross section corresponding to FIG. 4.

Referring to FIGS. 11 and 12, the antenna module according to the present example includes the substrate 10, the electronic element 50, and the chip antenna 100. Here, the electronic element 50 and the chip antenna 100 are similar to those of the above-described examples, and thus detailed descriptions thereof are omitted.

The substrate 10 of the present example is similar to the above-described example and has a difference in the shape of the ground region 11*b* and the feeder region 11*c* disposed on a first surface, an upper surface of the substrate 10.

The ground region 11*b* is disposed on the first surface of the substrate 10 to cover the entire region other than the element mounting portion 11*a*. The feeder region 11*c* is disposed such that the feeder region 11*c* partially digs into the ground region 11*b* to reduce the width of the ground region 11*b*. Here, the width of the ground region 11*b* means the length of a ground region disposed between the element mounting portion 11*a* and the feeder region 11*c*.

Also, the feeder region 11*c* is not formed in a continuous linear shape, but is configured such that a plurality of regions are spaced apart along the edge of the substrate 10.

Thus, the contour of the ground region 11*b* is disposed adjacent to the contour of the substrate 10 at a portion where the feeder region 11*c* is not disposed. However, the contour of the ground region 11*b* may be arranged in the same manner as the contour of the substrate 10.

Meanwhile, as described above, the resonance frequency of the chip antenna 100 may be changed when the distance P between the radiation portion 130*a* of the chip antenna 100 and the ground region 11*b* is less than 0.2 mm. Therefore, the distance P between the radiation portion 130*a* of the chip antenna and the ground region 11*b* of the substrate 10 is defined to be 0.2 mm or more. In order to minimize the size of the antenna module, the distance P between the radiation portion 130*a* and the ground region 11*b* of the substrate 10 may be defined as 1 mm or less.

In the present example, since the ground region 11*b* is also located on a third surface (a surface where the radiation portion and the ground region are both visible) of the chip antenna 100, the third surface of the chip antenna 100 and the ground region 11*b* are also spaced apart in the range equal to or more than 0.2 mm and less than or equal to 1 mm.

The size of the feeder region 11*c* in the present example is defined corresponding to the size of the chip antenna 100.

Meanwhile, the patch antenna 90 is not dependent on the size or shape of the feeder region 11*c*. Therefore, the patch antenna 90 of the present example may be disposed irrespective of the position of the feeder region 11*c*.

The antenna module according to the present example may minimize the size of the feeder region 11*c* and reduce the overall size of the antenna module.

Figure 13:
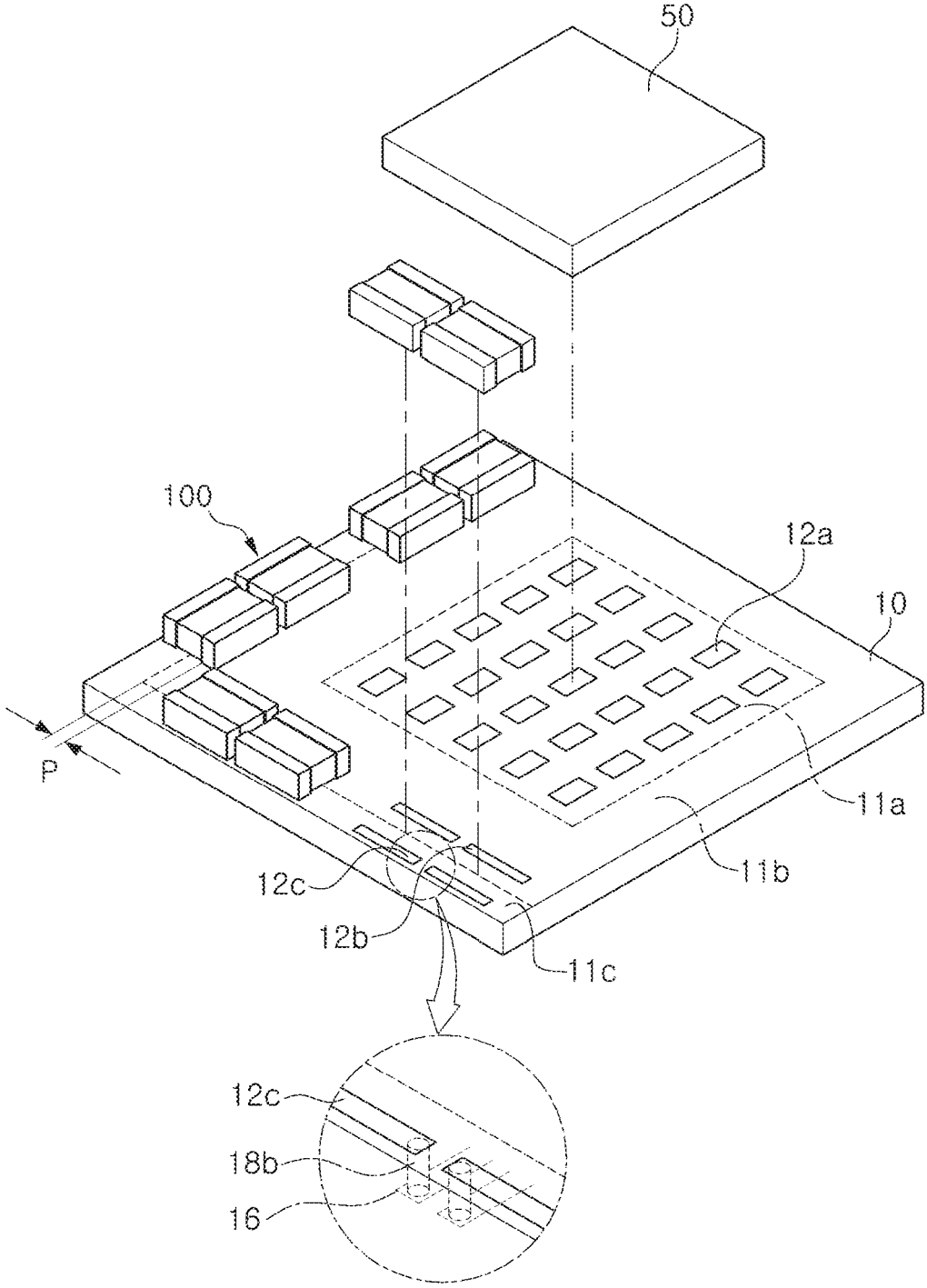
FIG. 13 is an exploded perspective view of an antenna module according to an example.

FIG. 13 is an exploded perspective view of an antenna module according to another example.

Referring to FIG. 13, the antenna module according to the present example is configured to be similar to an antenna substrate shown in FIG. 2, and has a difference in the structure of the feeder pad 12*c*.

The feeder pad 12*c* of the present example is formed to have the same or similar area (surface area) as that of a lower surface of the radiation portion 130*a* of the chip antenna 100. For example, the area (surface area) of the feeder pad 12*c* may be in the range of 80% to 120% of the area (surface area) of the lower surface of the radiation portion 130*a* of the chip antenna 100. However, the disclosure is not limited to such a configuration.

Accordingly, a pair of two feeder pads 12*c* are linearly formed and are spaced apart such that end portions face each other on a straight line.

When the area (surface area) of the feeder pad 12*c* is configured to be similar to the area of the lower surface of the radiation portion 130*a* of the chip antenna 100, the reliability of bonding between the chip antenna 100 and the substrate 10 may be increased.

Also, the interlayer connection conductors 18*b* (hereinafter, feeder vias) connected to the feeder pads 12*c* in the present example are respectively disposed at the end portions of the feeder pads 12*c*. The feeder via 18*b* extends into the substrate 10 in a direction perpendicular to the feeder pad 12*c* and is connected to the wiring layer 16 inside the substrate 10.

Two feeder pads 12*c* are arranged in pairs. Therefore, two feeder vias 18*b* connected to the feeder pads 12*c* are also arranged in pairs.

The pair of two feeder vias 18*b* are disposed at the end portions at which the pair of two feeder pads 12*c* face each other. For example, the feeder vias 18*b* may be arranged as close as possible. In this case, a distance between the two feeder vias 18*b* may be the same as or similar to the distance between the pair of two feeder pads 12*c*.

Figure 14:
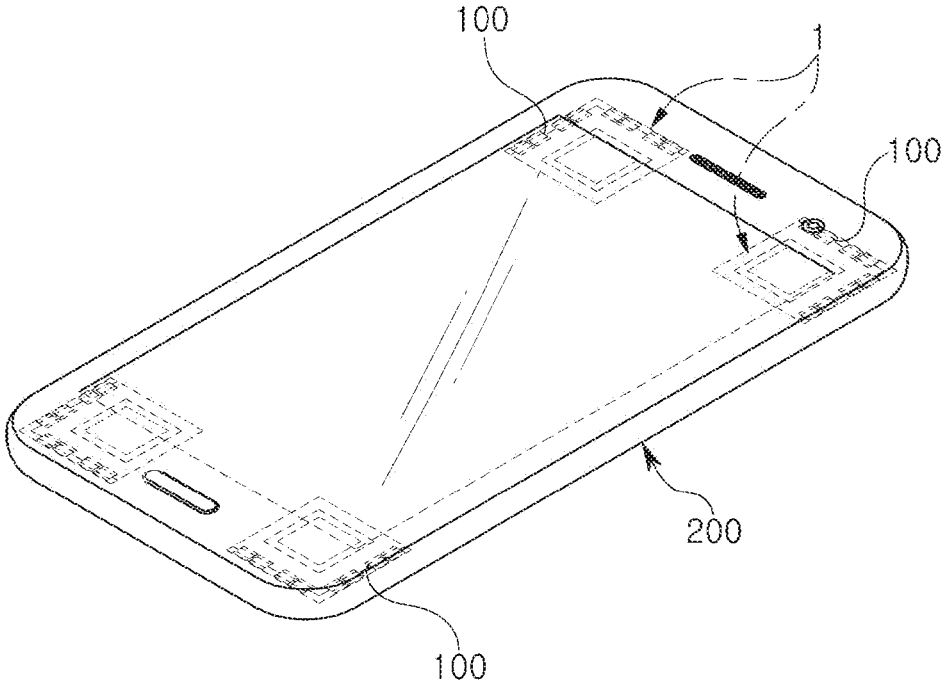
FIG. 14 is a perspective view schematically showing a portable terminal equipped with an antenna module according to an example.

FIG. 14 is a perspective view schematically showing a portable terminal 200 equipped with antenna modules 1 of the examples.

Referring to FIG. 14, the antenna modules 1 are disposed at corners of the portable terminal 200. The antenna modules 1 are disposed such that the chip antenna 100 is adjacent to the corners of the portable terminal 200.

The antenna modules 1 are disposed at all of four corners of the portable terminal 200. However, the present disclosure is not limited thereto. The arrangement structure of the antenna modules 1 may be variously modified, such as when an internal space of the portable terminal 200 is insufficient, only two antenna modules 1 are arranged in a diagonal direction of the portable terminal 200.

Also, the antenna modules 1 are coupled to the portable terminal 200 such that a feeder region is disposed adjacent to the edge of the portable terminal 200. Accordingly, radio waves radiated through a chip antenna of the antenna module 1 are radiated toward the outside of the portable terminal 200 in the surface direction of the portable terminal 200. Radio waves radiated through a patch antenna of the antenna module 1 are radiated in the thickness direction of the portable terminal 200.

As set forth above, an antenna module of the present disclosure uses a chip antenna instead of a wiring type dipole antenna, and thus the module size may be minimized. Also, the transmission/reception efficiency may be improved.

While examples have been shown and described above, it will be apparent to those skilled in the art that modifications and variations could be made without departing from the scope in the present disclosure as defined by the appended claims.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module comprising:

a substrate having a first surface including a ground region, a feeder region, and a mounting region;

an electronic element mounted on the mounting region;

chip antennas mounted on the first surface of the substrate; and at least one patch antenna disposed inside of the substrate or at least partially disposed on a second surface of the substrate, wherein each of the chip antennas include a body portion, a ground portion bonded to a first surface of the body portion, and a radiation portion bonded to a second surface of the body portion, wherein the ground portion of each of the chip antennas is mounted on the ground region and the radiation portion of each of the chip antennas is mounted on the feeder region, and wherein the substrate includes feeder pads disposed in the feeder region, each of the feeder pads being bonded to the radiation portion of a respective chip antenna and electrically connected to the electronic element.

2. The antenna module of claim 1, wherein the chip antennas are mounted on the substrate as pairs.

3. The antenna module of claim 1, wherein the mounting region is disposed inside of the ground region.

4. The antenna module of claim 3, wherein the feeder region is disposed along an edge of the substrate.

5. The antenna module of claim 3, wherein the feeder region includes regions spaced apart along an edge of the substrate.

6. The antenna module of claim 5, wherein the feeder region partially extends into the ground region to reduce a distance between the feeder region and the mounting region.

7. The antenna module of claim 1, wherein the feeder pads are arranged in pairs, and wherein a surface area of each of the feeder pads is less than half of a surface area of a lower surface of the respective radiation portion bonded thereto.

8. The antenna module of claim 1, wherein each of the chip antennas is mounted on the first surface of the substrate so as not to overlap the at least one patch antenna along a direction perpendicular to the first surface of the substrate.

9. The antenna module of claim 1, wherein at least two of the feeder pads are linearly formed and spaced from each other such that end portions face each other on a straight line, wherein feeder vias are respectively connected to the at least two feeder pads, and wherein the feeder vias are respectively disposed at the end portions of the feeder pads facing each other.

10. The antenna module of claim 9, wherein a distance between the at least two feeder pads is 0.2 mm or greater and 0.5 mm or less.

11. The antenna module of claim 1, wherein, for each of the chip antennas, a distance between the radiation portion and the ground region is greater than or equal to 0.2 mm and less than or equal to 1.0 mm.

12. The antenna module of claim 1, wherein the chip antennas are configured for wireless communications in a gigahertz frequency band and are configured to receive a feeder signal from a signal processing element and radiate the feeder signal to outside, wherein the body portion of each chip antenna is formed in a hexahedral shape having a dielectric constant and the first surface and the second surface are opposite surfaces of the body portion, wherein the radiation portion is formed in a hexahedral shape, and wherein the ground portion is formed in a hexahedral shape.

13. The antenna module of claim 12, wherein, for each of the chip antennas, a total width along a long side is less than or equal to 2 mm, and a ratio of a width of the radiation portion along the long side to a width of the body portion along the long side is greater than or equal to 0.10.

14. The antenna module of claim 13, wherein, for each of the chip antennas, the body portion is a dielectric substance having a dielectric constant of 3.5 or greater and 25 or less.

15. The antenna module of claim 12, wherein, for each of the chip antennas, a width of the radiation portion and a width of the ground portion are 50% or less of a width of the body portion.

16. The antenna module of claim 1, wherein the at least one patch antenna comprises:

a feeder electrode disposed inside of the substrate; and a non-feeder electrode disposed to be spaced apart from the feeder electrode by a predetermined distance.

17. The antenna module of claim 16, wherein the substrate includes a ground structure in the form of a container disposed around the at least one patch antenna to accommodate the at least one patch antenna.

18. The antenna module of claim 17, wherein the ground structure includes ground vias disposed along a circumference of the at least one patch antenna.

19. An antenna module comprising:

a substrate having a surface that includes a ground region, a feeder region, and a mounting region;

an electronic element mounted on the mounting region; and chip antennas mounted on the surface of the substrate, wherein each of the chip antennas includes a body portion, a ground portion coupled to a first surface of the body portion, and a radiation portion coupled to a second surface of the body portion, wherein, for each chip antenna, the ground portion is mounted on the ground region and the radiation portion is disposed outside of the ground region, wherein, for each antenna, a distance between the radiation portion and the ground region is greater than or equal to 0.2 mm and less than or equal to 1 mm, and wherein the substrate includes feeder pads disposed in the feeder region, each of the feeder pads being bonded to the radiation portion of a respective chip antenna and electrically connected to the electronic element.

20. The antenna module of claim 19, wherein the feeder region includes regions spaced apart along an edge of the substrate.

21. The antenna module of claim 19, wherein the chip antennas are used in wireless communications in a gigahertz frequency band and are configured to receive a feeder signal from a signal processing element and radiate the feeder signal to outside, wherein the body portion of each chip antenna is formed in a hexahedral shape having a dielectric constant and the first surface and the second surface are opposite surfaces of the body portion, wherein the radiation portion is formed in a hexahedral shape, and wherein the ground portion is formed in a hexahedral shape.

22. An apparatus comprising:

an antenna module including a substrate, a chip antenna mounted on a first surface of the substrate, an electronic element mounted on the first surface of the substrate;

a patch antenna disposed inside of the substrate or at least partially disposed on a second surface of the substrate, wherein a radiation portion of the chip antenna is coupled to a feeder region on the first surface of the substrate and the feeder region is disposed adjacent to an edge of the apparatus, and wherein the substrate includes a feeder pad disposed in the feeder region, the feeder pad being bonded to a radiation portion of the chip antenna and electrically connected to the electronic element.

23. The apparatus of claim 22, wherein the antenna module is disposed in the apparatus such that the chip antenna is adjacent to a corner of the apparatus.

24. The apparatus of claim 22, wherein the antenna module includes two or more chip antennas mounted on the first surface of the substrate and the two or more chip antennas are mounted in pairs.

25. The apparatus of claim 24, wherein the radiation portions of each of the chip antennas in a pair are disposed adjacent to each other.

* * * * *